US009366099B2

(12) United States Patent
Ly

(10) Patent No.: US 9,366,099 B2
(45) Date of Patent: Jun. 14, 2016

(54) DOPING OF DRILLING MUD WITH A MINERALOGICAL COMPOUND

(71) Applicant: CGG SERVICES SA, Massy (FR)

(72) Inventor: Chi Vinh Ly, Katy, TX (US)

(73) Assignee: CGG SERVICES SA, Massy (FR)

( * ) Notice: Subject to any disclaimer, the term of this patent is extended or adjusted under 35 U.S.C. 154(b) by 37 days.

(21) Appl. No.: 14/265,699

(22) Filed: Apr. 30, 2014

(65) Prior Publication Data

US 2015/0000978 A1 Jan. 1, 2015

Related U.S. Application Data

(60) Provisional application No. 61/839,544, filed on Jun. 26, 2013.

(51) Int. Cl.
*E21B 47/04* (2012.01)
*G01B 7/26* (2006.01)
*E21B 21/08* (2006.01)

(52) U.S. Cl.
CPC ..... *E21B 21/08* (2013.01)

(58) Field of Classification Search
CPC ..... E21B 47/04; G01B 7/26
See application file for complete search history.

(56) References Cited

U.S. PATENT DOCUMENTS 2,414,246 A 1/1947 Smith
2,660,887 A 12/1953 Frei
3,386,286 A 6/1968 Moore
4,708,212 A 11/1987 McAuley et al.
4,739,655 A 4/1988 Greer et al.
7,762,131 B2 * 7/2010 Ibrahim et al. ..... 73/152.55
2001/0036667 A1 11/2001 Tayebi et al.
2009/0151939 A1 6/2009 Bailey et al.
2011/0177984 A1 7/2011 Wilson et al.
2012/0253677 A1 10/2012 Frunza
2012/0325465 A1 12/2012 Hammer et al.

FOREIGN PATENT DOCUMENTS

WO 2010/088681 A2 8/2010

OTHER PUBLICATIONS

International Search Report and Written Opinion of the International Searching Authority in related International Application No. PCT/EP2014/063455, mailed May 28, 2015.

* cited by examiner

*Primary Examiner* — Catherine Loikith

(74) *Attorney, Agent, or Firm* — Patent Portfolio Builders PLLC

(57) ABSTRACT

Presented are methods and systems for tracking and assessing drilling fluid flow and performance and, accordingly, detecting drilling mud return depth. The drilling mud is injected with a mineralogical dopant in an amount that does not affect the physical or chemical properties of the drilling mud. The doped drilling mud is injected into a known mud pulse and a detector identifies the mud pulse in which the mineralogical dopant emerges from the borehole, allowing calculation of the drilling mud return depth.

8 Claims, 5 Drawing Sheets

DOPING OF DRILLING MUD WITH A MINERALOGICAL COMPOUND

RELATED APPLICATION

The present application is related to, and claims priority from U.S. Provisional Patent Application No. 61/839,544, filed Jun. 26, 2013, entitled "DOPING OF MUD USING A MINERALOGICAL AGENT," to Chi Vinh L Y, the disclosure of which is incorporated herein by reference in its entirety.

TECHNICAL FIELD

Embodiments of the subject matter disclosed herein generally relate to methods and systems for tracking and assessing drilling fluid flow and performance and, more particularly, to detecting drilling fluid return depth.

BACKGROUND

During the drilling of either vertical or horizontal wells for resource exploration and/or recovery, various drilling fluids, i.e., drilling muds, are employed to maintain well integrity and to clear the core hole of crushed material generated by the drilling process. The composition of the selected drilling mud is relevant because the ability of the drilling mud to transport drilling detritus to the surface greatly affects the drilling performance. The effective flow of the drilling mud is also relevant because the transported detritus comprises sediment, strata formation rock fragments and reservoir fluid which are analyzed to determine the subsurface formation that is presently at the location of the drill head.

One of the factors affecting the quality of the data derived from the drilling mud detritus is the accuracy of the depth assigned to the drilling mud pulse containing the associated detritus. The depth is estimated based on a calculation of mud flow velocity associated with the pumping rate. Unfortunately, due to changes in the drilling mud flow associated with changes in drilling conditions, depth shifts are a common occurrence. Attempts to improve drilling mud depth accuracy have even included introducing paint into the drilling mud but the requirement for visual inspection of the returning drilling mud has not improved the estimation of the drilling depth.

Accordingly, it would be desirable to provide systems and methods that avoid the afore-described problems and drawbacks associated with tracking and assessing drilling fluid flow and performance and, accordingly, detecting drilling mud return depth.

SUMMARY

According to an embodiment, there is a method for determining a drilling mud return depth from a borehole. The method includes selecting a mineralogical dopant for addition to said drilling mud wherein said mineralogical dopant is a single type of mineral; adding an amount of said mineralogical dopant to said drilling mud wherein said amount is lower than a threshold amount selected for said drilling mud; measuring a lag time between adding said mineralogical dopant to said drilling mud and detecting said mineralogical dopant in said drilling mud as said drilling mud exits said borehole; and computing a drilling mud return depth based on said lag time.

According to another embodiment, there is a method for determining a drilling mud return depth for a borehole and identifying drilling mud flow irregularities in said borehole.

The method includes selecting a plurality of mineralogical dopants for addition to said drilling mud; adding a trace amount of each of said plurality of mineralogical dopants to said drilling mud with a predefined time difference between each mineralogical dopant addition wherein said trace amount is selected based on said drilling mud; measuring a lag time between adding each of said plurality of mineralogical dopants to said drilling mud and detecting each of said plurality of mineralogical dopants in said drilling mud as said drilling mud exits said borehole; and computing a drilling mud return depth for each of said plurality of mineralogical dopants based on said lag time and determining drilling mud flow irregularities based on simultaneously detecting any two of said plurality of mineralogical dopants.

According to still another embodiment, there is a system for tracking and assessing a drilling mud. The system includes a drilling mud; one or more mineralogical dopants; a mineralogical dopant deliverer for delivering predetermined trace amounts of said mineralogical dopant into said drilling mud; a drilling mud transport system for circulating said drilling mud and said mineralogical dopant across an associated drill head; a mineralogical analysis tool, coupled to said drilling mud transport system, for detecting and quantifying said one or more mineralogical dopants in said drilling mud; and a controller for calculating a return time of the one or more mineralogical dopants.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. Some of the following embodiments are discussed, for simplicity, with regard to the terminology and structure of tracking and assessing drilling fluid flow and performance and, accordingly, detecting drilling mud return depth. However, the embodiments to be discussed next are not limited to these configurations, but may be extended to other arrangements as discussed later.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to various embodiments described herein, methods and systems for tracking and assessing drilling fluid flow and performance and, detecting drilling mud return depth are described. The methods and systems are based on adding one or more mineral dopants to the drilling mud and in some embodiments, using a bulk mineral analysis tool to detect and measure the concentration of the mineral dopant in the drilling mud returning to the surface. Such methods and systems can, for example, be used to track and assess drilling fluid flow and performance and, detecting drilling mud return depth.

Figure 1:
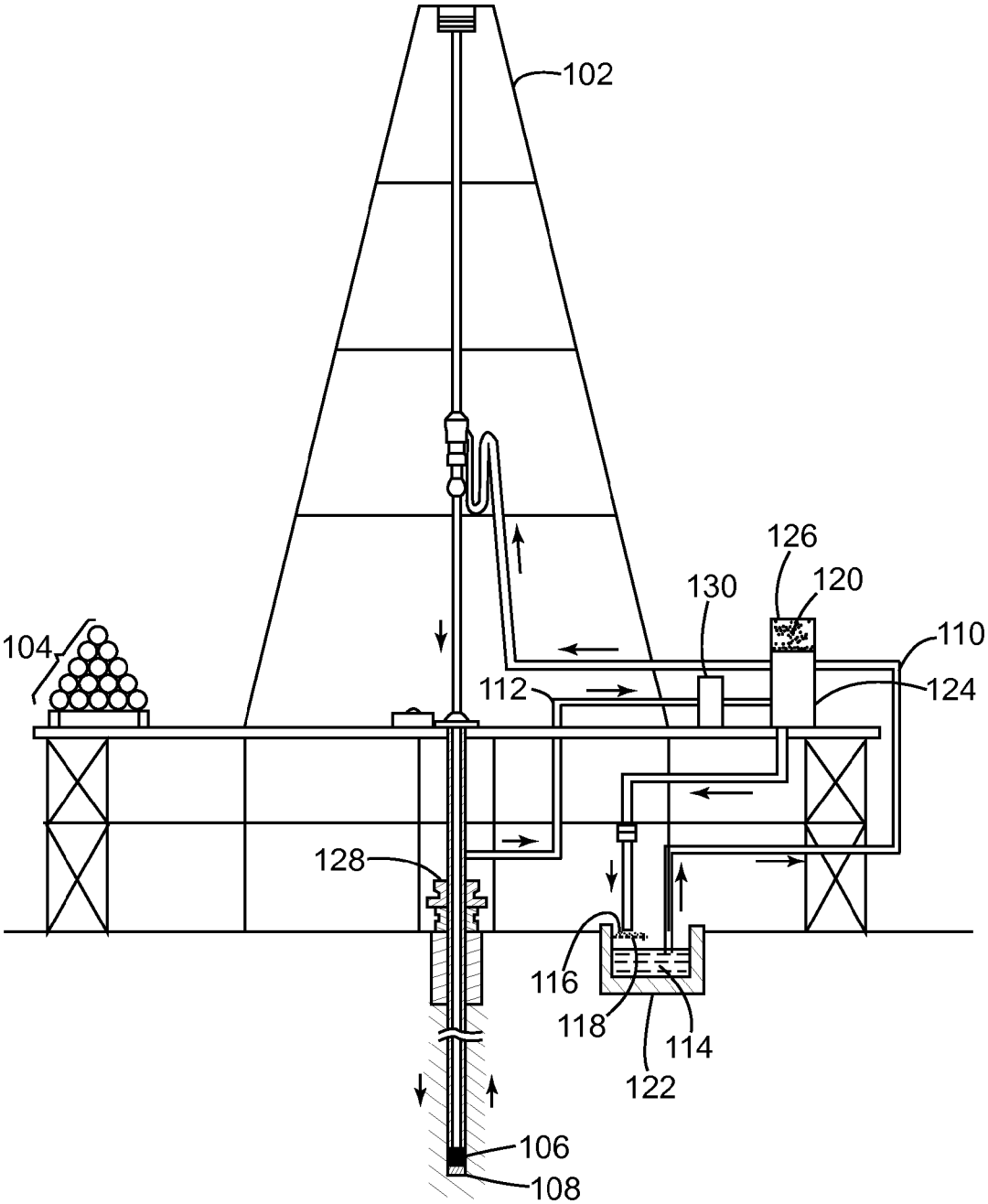
FIG. 1 depicts an onshore drilling system.

Providing a context for the subsequent embodiments and looking to FIG. 1, it is known to those skilled in the art that a drilling system comprises drilling derricks 102, drilling pipe 104, drill bits 106 suitable for the strata 108, supply 110 and return 112 lines for drilling mud 114 and cuttings 116 associated with the drilling operation, separation systems 118 for isolating the cuttings 116 from the drilling mud 114, a drilling mud reservoir 122 and a drilling mud pump 124. It should be noted that other aspects and configurations, known to those skilled in the art, are comprised in a drilling operation and that the described configurations are applicable to both onshore and offshore drilling operations.

With the aforementioned context in mind, some mineral doped drilling mud and bulk mineral analysis tool configurations according to embodiments will now be described. Improving the ability to track drilling mud lag, i.e., track the time it takes the drilling mud 114 to travel from the drill bit 106 to the well head 128 for collection (which time is then used to compute a depth of drill bit 106), comprises the use of one or more mineralogical dopants 120 added to the drilling mud 114 and one or more measurement tools 130 for detecting when the mineralogical dopant 120 arrives at the well head 128, after traveling to drill bit 106 and back, and the concentration of the mineralogical dopant 120 in the drilling mud 114.

Note that the measurement tools 130 available for use at the well site allow for rapid, e.g., instantaneous, mineralogical assessment of drilling mud 114 and/or cuttings 116 transported to the well head 128 by the drilling mud 114. It should further be noted that examples of measurement tools 130 include, but are not limited to, x-ray diffraction detectors, electromagnetic scanners, infrared spectrometers and electron microscopy such as a Scanning Electron Microscope (SEM) or a Transmission Electron Microscope (TEM). Use of one or more of the measurement tools 130 and a properly selected mineralogical dopant 120 provides a system to measure a drilling mud lag depth. It should be noted that a mineralogical dopant 120 is a mineral that does not readily occur at the location of the drilling wherein examples of the mineralogical dopant 120 includes pentandite, corundum, chromite, galena, etc, or other economically feasible artificial compounds such as, but not limited to, amorphous materials, silicates, silica materials, mesoporous materials, sulfide minerals, nanoparticles, etc. Further, a particle size for a mineralogical dopant 120 may range from approximately 3 millimeters in average diameter down to a minimum size detectable by the applicable previously described measurement tools 130, and a nanoparticle can range in size between 2,500-10,000 nanometers.

Next, the methods and systems can use either a single mineralogical dopant 120 or multiple mineralogical dopants 120 introduced into the drilling mud 114 at different times. Looking to an embodiment operating with a single mineralogical dopant 120, the mineralogical dopant 120 is added to the drilling mud 114 and the drilling mud pulse is recorded at the time the mineralogical dopant 120 is added. It should be noted that the exact quantity of the added mineralogical dopant 120 is based on the specified drilling mud chemistry, which itself is based on factors such as, but not limited to, operator selection, drilling mud designer selection and the characteristics of the strata at the site of the borehole. In general, an amount of a mineralogical dopant 120 is lower than a threshold value of approximately 10 percent by weight, i.e., an amount that will not affect the physical or chemical properties of the designed drilling mud 114.

Drilling mud 114 circulates around the drill bit 106 collecting cuttings 116, generated by the drilling, and returns to the surface. As the drilling mud 114 arrives at the surface, a detailed mineralogical analysis of the drilling mud 114 and/or cuttings 116 is performed by one or more of the previously defined measurement tools 130. In one application, the analysis is performed on the cuttings. However, in another application, the analysis is performed on the mud itself. For both applications, the cuttings may be separated from the mud prior to using the measurement tool 130. Based on the analysis, the measurement tools 130 can detect subtle changes in the drilling mud 114 and/or cutting's 116 mineralogy based on the introduced mineralogical dopant 120 and provide the drilling mud lag time, a measure of the drilling mud 114 dispersion and other issues associated with drilling mud 114 flow.

In another embodiment, multiple mineralogical dopants 120 may be used so that the above described embodiments are extended by adding a different mineralogical dopant 120 at a later time than the first mineralogical dopant 120. Further, in a similar fashion, additional mineralogical dopants 120 can be added at a subsequent time wherein the drilling mud pump 124 pulse is recorded each time a mineralogical dopant 120 is added. The additional benefits of an embodiment operating with a plurality of mineralogical dopants 120 comprises removing the requirement that a mineralogical dopant 120 be fully circulated out of the borehole before another mineralogical dopant 120 can be re-introduced, providing for shorter gaps between monitoring of drilling mud 114 performance and drilling mud 114 lag depth, and providing the capability to determine possible recirculation issues, i.e., determining if a combination of mineralogical dopants 120 appear simultaneously in any one, or set of, retrieved cutting 116 samples or mud.

Considering additional advantages of the previously described embodiments, the use of a mineralogical dopant 120 instead of an elemental dopant, i.e., a dopant that is a single element, comprises a lower cost and a wider selection based on the inability to use certain elemental dopants due to complex formation mineralogy, i.e., the elemental analysis is corrupted by the elements in the mineralogical compounds. Accordingly, more exotic and expensive elements are required as dopants.

Figure 2:
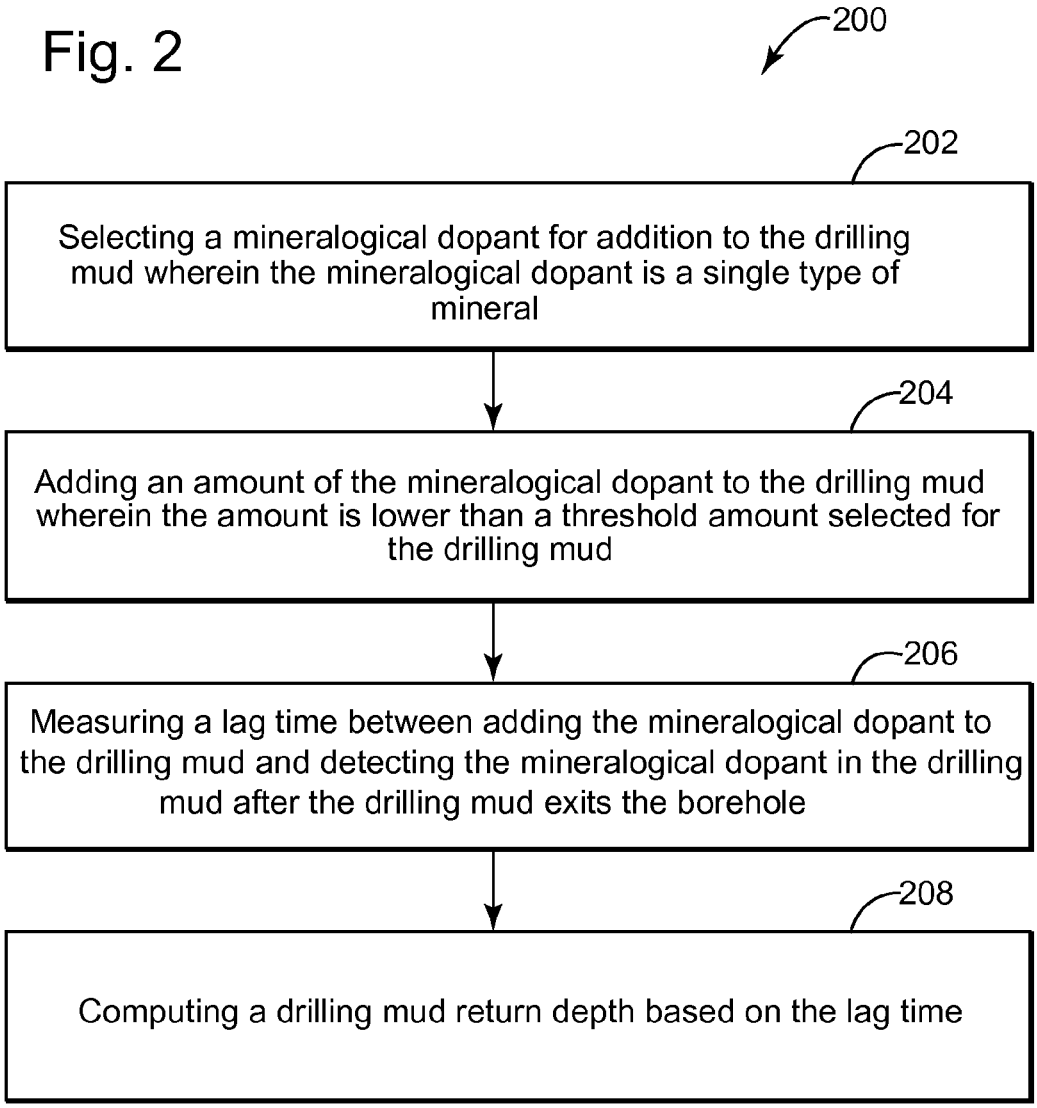
FIG. 2 depicts a method flowchart for determining a drilling mud return depth.

Looking to FIG. 2, a method 200 for determining a drilling mud return depth from a borehole is depicted. Starting with step 202, a mineralogical dopant is selected for addition to a drilling mud. It should be noted in the method 200 that the mineralogical dopant is a single type of mineral.

Continuing at step 204 of the method 200, the mineralogical dopant is added to the drilling mud. The amount of mineralogical dopant added to the drilling mud is lower than a threshold amount based on the associated drilling mud. The threshold amount of mineralogical dopant may be less than approximately ten percent by weight of the associated drilling mud.

Next at step 206 of the method 200, a lag time between adding the mineralogical dopant to the drilling mud and detecting the mineralogical dopant in the drilling mud, after the drilling mud has exited the borehole, is measured. It should be noted that the mineralogical dopant can be detected and measured by one or more of the previously described measurement tools. Continuing at step 208 of the method 200, a drilling mud return depth is computed based on the previously measured lag time. It should be noted that the computation may be based on a pumping rate and the associated drilling mud flow.

Figure 3:
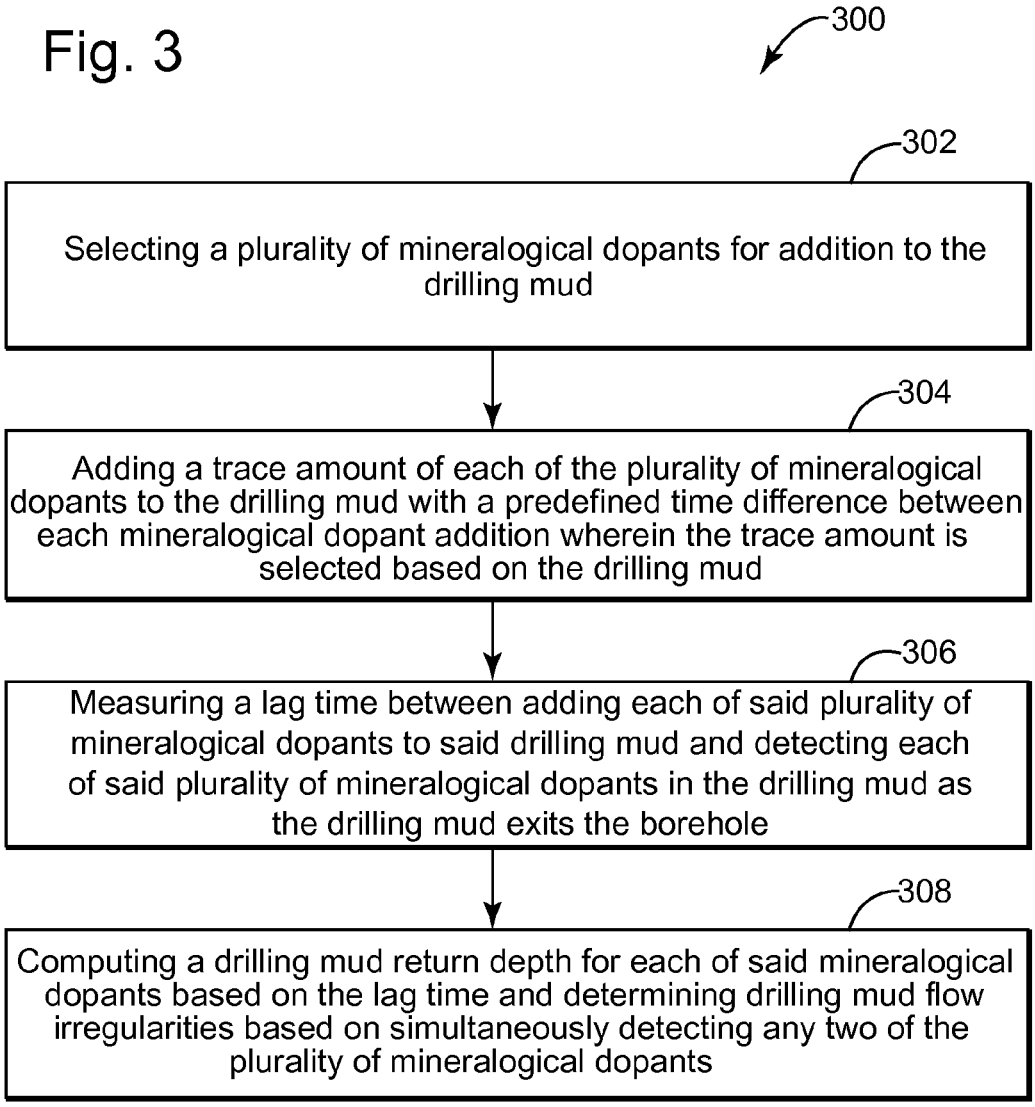
FIG. 3 depicts a method flowchart for determining a drilling mud return depth and identifying drilling mud flow irregularities.
Figure 4:
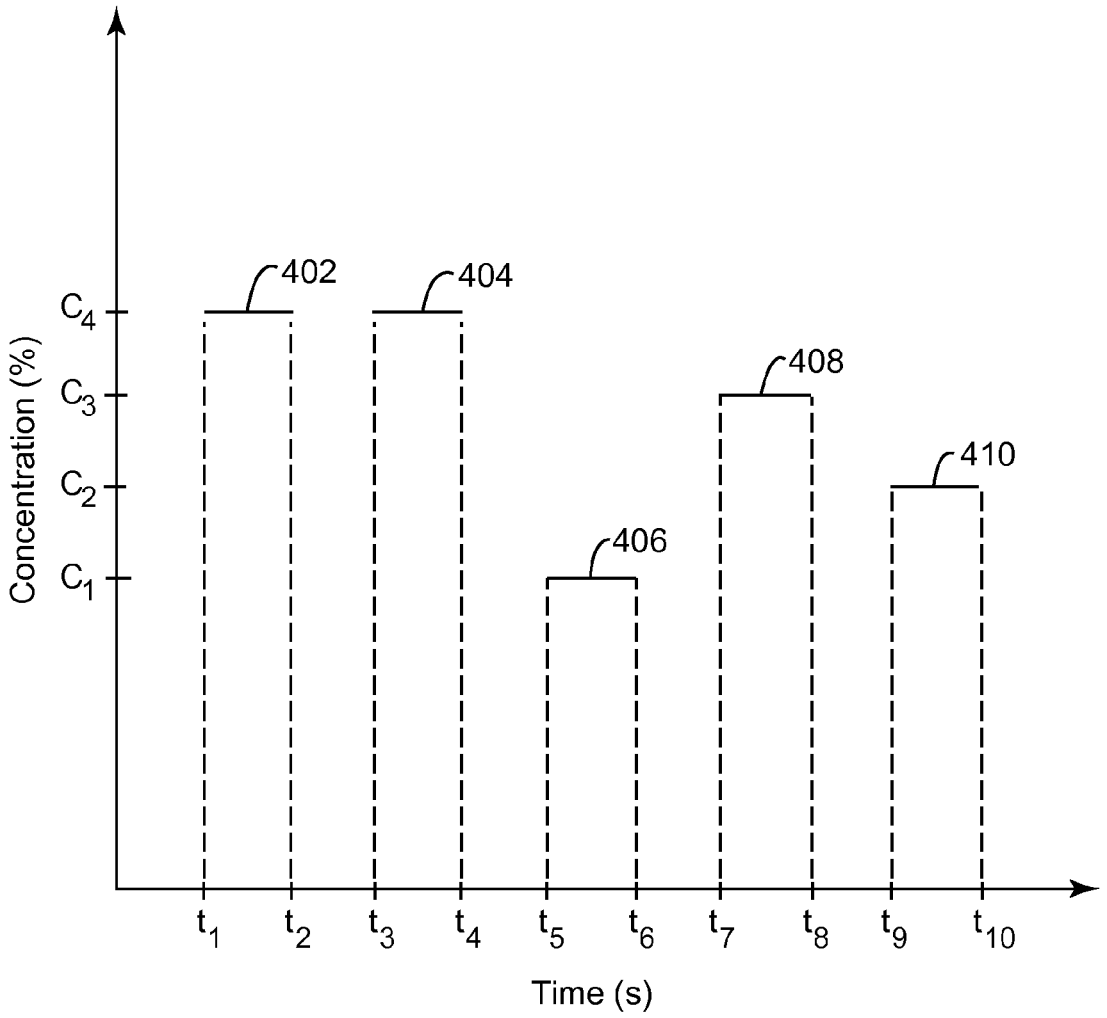
FIG. 4 depicts a concentration versus time graph for mineralogical dopant additions to drilling mud.

FIG. 3 illustrates a method 300 for generating a drilling mud associated with tracking and assessing drilling mud flow irregularities and, accordingly, detecting drilling mud return depth is depicted. Starting with step 302, a plurality of mineralogical dopants are selected for addition to the drilling mud. Next at step 304, a trace amount of each of the plurality of mineralogical dopants is added to the drilling mud with a predefined time difference between each mineralogical dopant addition wherein the trace amount is selected based on the drilling mud. It should be noted in the method 300 that the trace amount is less than approximately 3 percent by weight of the associated drilling mud. For example, FIG. 4 depicts a graph of the addition of 5 mineralogical dopants 402, 404, 406, 408, 410 to the drilling mud. Two of the mineralogical dopants 402, 404 are the same concentration (C4) but not necessarily the same mineralogical compound. The first mineralogical dopant is delivered to the drilling mud from time $t_1$ until time $t_2$ and the second mineralogical dopant 404 is delivered to the drilling mud from time $t_3$ until time $t_4$. It should be understood from the example illustrated in FIG. 4 that the additions of the mineralogical dopant to the drilling mud do not overlap in time. However, in another application, two or more mineralogical dopants may be added so that they overlap in time. In one application, the added mineralogical dopants have a substantially constant concentration during their respective time windows, as illustrated in FIG. 4. In one application, as also illustrated in FIG. 4, the addition of the mineralogical dopants is staggered in time. Continuing with the example, another 3 mineralogical dopants 406, 408, 410, of three different concentrations, $C_1$, $C_2$, $C_3$ respectively, are added to the drilling mud during three non-overlapping time windows, $t_5$ to $t_5$, $t_7$ to $t_8$ and $t_9$ to $t_{10}$ respectively. It should be noted that the 3 mineralogical dopants 406, 408, 410 may or may not be the same mineralogical compound and they also can be added in overlapping time windows as long as their concentration is substantially constant.

Next at step 306, a lag time is measured between the additions of each of the plurality of mineralogical dopants to the drilling mud and the detection of each of the plurality of mineralogical dopants in the drilling mud as the drilling mud exits the borehole. It should be noted that the use of multiple mineralogical dopants allows for a finer resolution of the determination of the drilling mud return depth because one does not have to wait for the previously added mineralogical dopant to exit the borehole. At step 308, a drilling mud return depth is computed for each mineralogical dopant based on the lag time for each mineralogical dopant, and drilling mud flow irregularities are determined based on simultaneously detecting any two of the plurality of mineralogical dopants. In an optional step, the drilling mud return depth of the plural mineralogical dopants is averaged. Note that a computing device that calculates the drilling mud return depth has access to a database that includes information related to derrick 102, for example, lengths of paths 110 and 112, exact position of head 128, etc. In this way, although mineralogical dopant 120 is inserted at mud pump 126, which may be away from derrick 102, and although returning mineralogical dopant 120 is detected at tool 130, which also may be away from derrick 102, the computing device can take into account the exact positions of mud pump 126 and tool 130 relative to head 128 and accurately calculate the depth of the drill bit 106.

Figure 5:
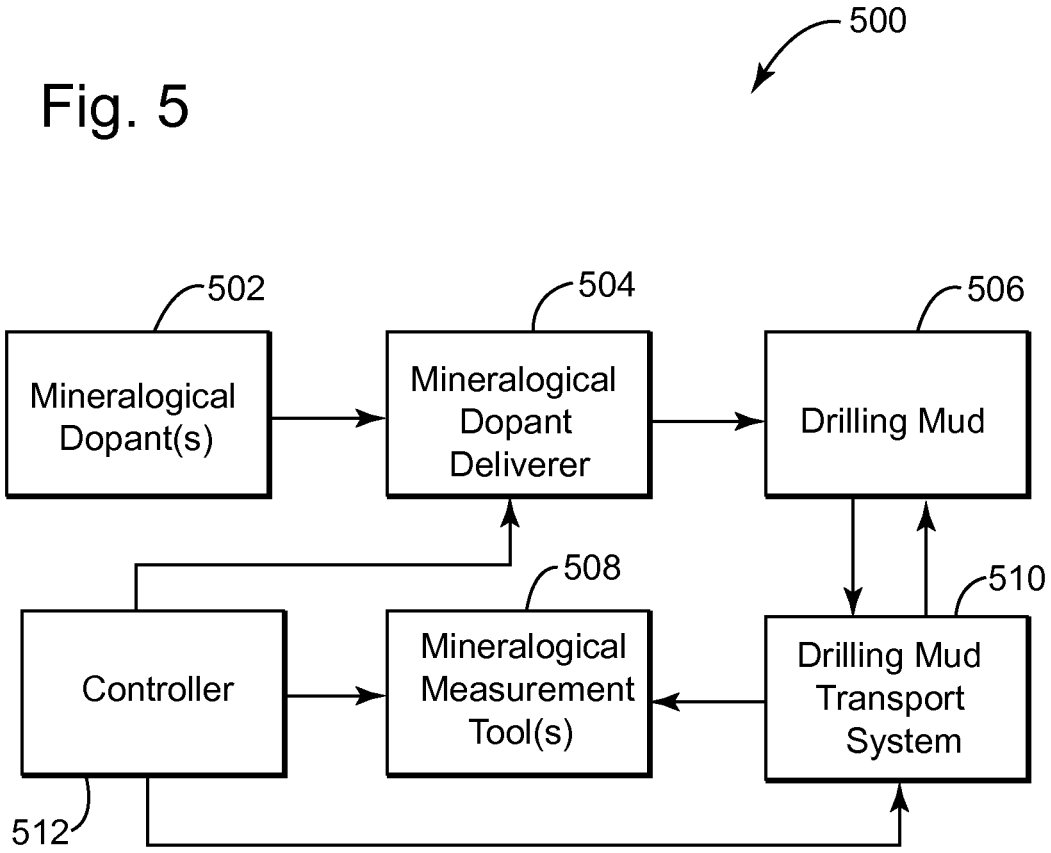
FIG. 5 depicts a system for tracking and assessing a drilling mud.

Looking now to FIG. 5, a system 500 for tracking and assessing drilling fluid flow and performance and, accordingly, detecting drilling mud return depth is depicted. The system 500 comprises a mineralogical dopant 502, a mineralogical dopant deliverer 504, drilling mud 506, one or more mineralogical measurement tools 508 and a drilling mud transport system 510. The mineralogical dopant 502 can be composed of, but is not limited to, crushed media of a single type of mineral or nanoparticles. It should be noted that the mineralogical dopant can be smaller than three millimeters and at least as large as the minimum diameter detectable by the previously describe measurement tools 508. It should further be noted that the mineralogical dopant 502 should be a mineral that does not readily occur in the location of the borehole, i.e., the dopant must be discernable from other particulate matter that enters the drilling mud as a byproduct of the drilling operation.

Continuing with the system 500, the mineralogical dopant deliverer 504 provides the capability to deliver the mineralogical dopant 502 into the drilling mud 506. It should be noted in the system 500 that the mineralogical dopant deliverer 504 records the specific mud pulse in which the mineralogical dopant 502 is delivered. It should further be noted in the system 500 that the drilling mud 506 is selected for the drilling operation based on characteristics of the strata at the site of the borehole.

Continuing with one or more mineralogical measurement tools 508, one or more measurements are performed by the one or more mineralogical measurement tools 508, based on any of the previously described measurement tools 508. The measurement provides for an accurate detection of the mineralogical dopant 502 at the previously specified concentrations without requiring sampling of the drilling mud 506 effluent and transportation of the effluent to a lab for analysis. It should be noted in the system 500 that the one or more mineralogical measurement tools 508 are coupled to the drilling mud transport system 510 in such a way that the one or more mineralogical measurement tools 508 can perform an analysis on the drilling mud as it exits the borehole. It should further be noted in the system 500 that the drilling mud transport system 510 is comprised of piping, pumps, and reservoirs suitable to store a sufficient supply of drilling mud, deliver the drilling mud to the drill bit and return the drilling mud and cuttings from the drill bit to the surface. System 500 also includes a computing device 512 that is capable to control one or more of the units discussed with regard to FIG. 5, and also to keep track of the timing of delivering and determining the mineralogical dopant to and from the mud. In this way, the computing device 512 is able to instantaneously and accurately calculate the depth of the well.

The disclosed embodiments provide a method and system for tracking and assessing drilling fluid flow/performance and detecting drilling mud return depth. It should be understood that this description is not intended to limit the invention. On the contrary, the exemplary embodiments are intended to cover alternatives, modifications and equivalents, which are included in the spirit and scope of the invention. Further, in the detailed description, numerous specific details are set forth in order to provide a comprehensive understanding of the embodiments. However, one skilled in the art would understand that various embodiments may be practiced without such specific details.

Although the features and elements of the present embodiments are described in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for determining a drilling mud return depth for a borehole and identifying drilling mud flow irregularities in said borehole, said method comprising:

selecting a plurality of mineralogical dopants for addition to said drilling mud;

adding a trace amount of each of said plurality of mineralogical dopants to said drilling mud, with a predefined time difference between each mineralogical dopant addition, wherein said trace amount is selected based on said drilling mud;

measuring a lag time between adding each of said plurality of mineralogical dopants to said drilling mud and detecting each of said plurality of mineralogical dopants in said drilling mud as said drilling mud exits said borehole; and computing a drilling mud return depth for each of said plurality of mineralogical dopants based on said lag time and determining drilling mud flow irregularities based on simultaneously detecting any two of said plurality of mineralogical dopants.

2. The method of claim 1, wherein said trace amount is three percent by weight.

3. The method of claim 1, wherein a particle diameter of said mineralogical dopant is larger than 30 micrometers and smaller than 3 millimeters.

4. The method of claim 1, wherein a particle diameter of said mineralogical dopant is larger than 70 micrometers and smaller than 2 millimeters.

5. The method of claim 1, wherein a mineralogical dopant particle is a nanoparticle sized between 2,500 and 10,000 nanometers.

6. The method of claim 1, wherein said mineralogical dopant is a sulfide mineral.

7. The method of claim 1, wherein said mineralogical dopant is an oxide mineral.

8. The method of claim 7, wherein said oxide mineral comprises corundum or chromite.

* * * * *